US011713589B2

(12) United States Patent
Durham

(10) Patent No.: US 11,713,589 B2
(45) Date of Patent: Aug. 1, 2023

(54) FENCING SYSTEM

(71) Applicant: HAMPTON STEEL LIMITED, Northamptonshire (GB)

(72) Inventor: Christopher John Walter Durham, London (GB)

(73) Assignee: HAMPTON STEEL LIMITED, Northamptonshire (GB)

( * ) Notice: Subject to any disclaimer, the term of this patent is extended or adjusted under 35 U.S.C. 154(b) by 778 days.

(21) Appl. No.: 16/065,708

(22) PCT Filed: Jan. 19, 2017

(86) PCT No.: PCT/GB2017/050119
§ 371 (c)(1),
(2) Date: Jun. 22, 2018

(87) PCT Pub. No.: WO2017/125736
PCT Pub. Date: Jul. 27, 2017

(65) Prior Publication Data

US 2018/0371788 A1 Dec. 27, 2018

(30) Foreign Application Priority Data

Jan. 19, 2016 (GB) ..... 1600991

(51) Int. Cl.
*E04H 17/12* (2006.01)
*E04H 17/10* (2006.01)
(Continued)

(52) U.S. Cl.
CPC ..... *E04H 17/124* (2021.01); *E04H 17/006* (2021.01); *E04H 17/05* (2021.01); *E04H 17/21* (2021.01)

(58) Field of Classification Search
CPC ..... E04H 17/04; E04H 17/06; E04H 17/10; E04H 17/12; E04H 17/124; E04H 17/161;
(Continued)

(56) References Cited

U.S. PATENT DOCUMENTS 487,374 A * 12/1892 Parker ..... E04H 17/10 256/57
752,854 A * 2/1904 Odell ..... E04H 17/10 256/48

(Continued)

FOREIGN PATENT DOCUMENTS

AU 8520998 4/1999
CA 2894334 12/2015

(Continued)

OTHER PUBLICATIONS

Translation of FR 3 014 129: worldwide.espacenet.com. Nov. 23, 2022.*

(Continued)

*Primary Examiner* — Michael P Ferguson
(74) *Attorney, Agent, or Firm* — Haynes Beffel & Wolfeld LLP; Andrew L. Dunlap

(57) ABSTRACT

A metal fencing system is provided. The metal fencing system can include a plurality of metal fence posts and a plurality of retaining clips, each metal fence post comprising a plurality of discrete apertures arranged to receive a coupling portion of a retaining clip; wherein each retaining clip comprises a central fencing wire securing portion and two opposing coupling portions arranged in use to cooperate with the discrete apertures and to secure the retaining clip to the metal fence post.

13 Claims, 11 Drawing Sheets

(51) Int. Cl.
*E04H 17/04* (2006.01)
*E04H 17/00* (2006.01)
*E04H 17/20* (2006.01)

(58) Field of Classification Search
CPC ..... E04H 17/163; E04H 17/24; E04H 17/20; E04H 17/006; E04H 17/02; E04H 17/05; E04H 17/21
USPC ..... 256/47, 48, 52
See application file for complete search history.

(56) References Cited

U.S. PATENT DOCUMENTS 803,706 A * 11/1905 McMaster ..... E04H 17/06 256/51
987,485 A * 3/1911 Peterson ..... E04H 17/10 256/54
1,186,062 A * 6/1916 Anglemeyer ..... E04H 17/10 256/48
1,214,749 A * 2/1917 Bruflat ..... E04H 17/10 256/48
1,236,150 A * 8/1917 Daniels ..... E04H 17/10 256/54
1,426,469 A * 8/1922 Fitch ..... E04H 17/10 256/32
1,516,179 A * 11/1924 Ferris ..... E04H 17/10 256/54
1,925,488 A * 9/1933 Kern ..... E04H 17/10 256/54
2,355,767 A 8/1944 White
2,635,857 A * 4/1953 Banister ..... E04H 17/20 256/19
3,169,750 A 2/1965 Weed
3,350,067 A * 10/1967 Coda ..... E04H 17/10 256/48
3,861,247 A * 1/1975 Gerschwiller ..... E04H 17/268 81/484
4,180,247 A * 12/1979 Pfarr, Jr. ..... E04H 17/10 24/563
4,910,933 A * 3/1990 Schwarzfeller ..... E04H 17/161 256/47
5,676,351 A * 10/1997 Speece ..... E04H 17/10 256/54
5,746,040 A * 5/1998 Young ..... E04H 17/161 52/285.3
5,921,530 A * 7/1999 Joyce ..... F16G 11/00 256/48
6,330,998 B1 * 12/2001 Roy ..... E04H 17/20 256/60
6,595,497 B1 7/2003 Linford et al.
6,902,152 B1 * 6/2005 Clifford ..... E04H 17/1413 256/47
10,323,436 B2 * 6/2019 White ..... A01K 3/005
10,767,825 B2 * 9/2020 Chia ..... F21S 8/085
2005/0056822 A1 * 3/2005 Linford ..... B29C 65/00 256/59
2009/0140224 A1 6/2009 Ratanasiriwilai
2010/0283023 A1 11/2010 Thompson
2012/0256147 A1 10/2012 Sachs et al.
2015/0225978 A1 * 8/2015 White ..... E04H 17/10 256/46

FOREIGN PATENT DOCUMENTS

CN 200968085 10/2007
CN 104775659 7/2015
EP 0433621 6/1991
FR 2429309 1/1980
FR 2465852 A1 * 3/1981 ..... E04H 17/10
FR 2465852 A1 3/1981
FR 2853205 10/2004
FR 2853205 A3 * 10/2004 ..... E04H 17/10
FR 3 014 129 * 6/2015 ..... E04H 17/08
GB 932259 7/1963
GB 2440533 2/2008
WO 2006085183 A1 8/2006
WO 2014032098 3/2014
WO 2014134660 9/2014

OTHER PUBLICATIONS

GB Search Report (part 1) in priority Application No. GB1600991.2 dated Aug. 18, 2016, 9 pages.
GB Search Report (part 2) in priority Application No. GB1600991.2 dated Mar. 23, 2017, 3 pages.
GB Search Report (part 3) in priority Application No. GB1600991 2 dated Mar. 23, 2017, 3 pages.
PCT Search Report and Written Opinion from PCT/GB2017/050119 dated Mar. 30, 2017, 15 pages.
PCT IPRP and Written Opinion from PCT/GB2017/050119 dated Aug. 2, 2018, 11 pages.
EP 20186945.0—Extended EP Search Report dated Dec. 2, 2020, 8 pages.

* cited by examiner

FENCING SYSTEM

FIELD

The present teachings relate to a fencing system. Particularly, but not exclusively, the teachings are concerned with a fencing system which uses a new metal fence post for agricultural use or the like.

BACKGROUND

Conventional agricultural fencing systems have been used for decades and use staples which are driven into wooden fence posts to secure the fencing wire to the post. These systems are typically used to confine livestock and are straightforward to assemble and erect on-site by either a contractor or end user e.g. farmer or herdsman. In the right hands, and with the correct equipment, conventional post and staple fencing is not only convenient to erect but it is also inexpensive to manufacture and purchase. The posts can be harvested from managed forests and expensive metal components can be kept to a minimum. Thus large areas can be enclosed at low cost.

However, conventional fences are by their nature exposed to the elements such as rain and frost and therefore the durability of the wooden fence posts can be a significant issue. Harder woods have longer lifespans but due to the requirement that the fence post material is sufficiently soft to allow the staples to be driven in, hardwoods cannot easily be used.

To address this problem manufacturers increase the durability and lifespan of fence posts by chemically treating the wooden fence posts before they are used. Typically chemicals, such as creosote, are used to drive out water from the wooden posts and significantly increase the lifespan of the posts. Manufacturers can thereby provide fencing materials which are simple to erect, use wood as a primary material and overcome the problems discussed above in respect of product lifespan.

The present inventor has recognised an alternative system which maintains the ease and speed with which conventional fencing can be erected and also offers still further extended lifespan.

SUMMARY

Particular aspects and embodiments are set out in the accompanying claims.

According to a first aspect of the teachings there is provided a metal fencing system comprising a plurality of metal fence posts and a plurality of retaining clips. Each metal fence post comprises a plurality of discrete apertures arranged to receive a coupling portion of a retaining clip. Each retaining clip comprises a central fencing wire securing portion and two opposing coupling portions arranged in use to cooperate with the discrete apertures and to secure the retaining clip to the metal fence post.

Thus, a fencing system is provided which allows a metal to be used for the fence posts which is straightforward to assemble and erect and is highly flexible in terms of the way fencing wire can be secured. The use of metal fence posts allows the system to be durable and avoids the need for the use of treatment chemicals while providing for a low lifetime cost.

Metal fencing systems have not previously been thought feasible, particularly because of the time metal fencing takes to erect. Conventional metal fencing systems involve attaching a metal grill or mesh to a metallic post using nuts and bolts or even by welding. This provides a high strength and high integrity barrier but takes substantially longer to erect and is substantially more expensive.

According to the present teaching a specially adapted retaining clip is used in combination with a specially adapted metal post to provide a high integrity barrier which can be easily and quickly installed.

The plurality of discrete apertures formed on each post advantageously allows conventional fencing wire to be conveniently secured in a plurality of different locations i.e. at positions selected at the discretion of the person erecting the fence.

The term "discrete aperture" is intended to refer to a unique aperture or hole in a part of the metal post as opposed to a slot extending along the entire length of a post.

The fencing wire itself may for example take the form of individual wires or a matrix of wires forming a mesh or woven wire fencing as are known in the art. According to a teaching described herein a variety of different fencing wire shapes and layouts can be accommodated according to the fencing system described herein.

As discussed above, the plurality of discrete apertures allows for flexibility in the location of the retaining clips which in turn provides flexibility in accommodating different types of wire mesh sizes.

The plurality of apertures furthermore allows undulations in the ground on which the fence system is erected to be accommodated.

In some examples, the plurality of discrete apertures may be uniformly spaced along at least part of the length of the surface. Such a configuration allows for identical retaining clips to be used anywhere along the uniform region conveniently facilitating the securing of the fencing wire at the appropriate height for example in response to the expected loads and strains on the fence.

The cooperation of the retaining clip with the apertures in the metal post means that a fencing wire or mesh can be connected to and retained by a high strength post in a highly secure way.

Turning to the retaining clips, as stated above, each retaining clip comprises a central fencing wire securing portion (a part of the clip which secures the wire against the post) and two coupling portions (portions that couple the clip to the metal post). The term "opposing" is intended to mean that each coupling portion is located at opposing sides or ends of the fencing wire securing portion so as to connect the clip to the post on either side of the securing portion.

The two coupling portions may be at opposing ends of the central fencing wire securing portion. Such a configuration allows for the retaining clip to be attached independently at each end (with the wire retaining portion or surface extending there between) such that fencing wire can be firmly secured between the retaining portion and post. The coupling portions may then be coupled to the post independently or simultaneously.

The clip itself may be formed of a variety of shapes. Each clip may for example be formed from a length of metal wire having a generally straight central portion (defining the central fencing wire securing portion) which, in use, overlaps and presses against a portion of the wire to be restrained, and a serpentine portion at either end (defining the coupling portions) arranged to engage with the respective discrete apertures of the metal post.

Thus, when each of the coupling portions is inserted into a respective aperture the wire is securely retained between the metal fence post (into which the coupling portions are inserted) and the central fencing wire securing portion which extends between the coupling portions.

The clip material is selected according to the desired mechanical properties of the clip, in terms of the desired flexibility during installation and strength in operation.

The serpentine portions may be in a general U or V shape (or the like) where the apex of the U or V is arranged in use to face and penetrate the discrete apertures of the post. In such an arrangement one of the distal ends of the U or V may be coupled to or integral with the length of wire forming the wire securing portion. The other distal end may then be free. Thus, a clip can be formed of a single length of wire providing simple and reliable operation and cost effective manufacture. Other shapes which must be compressed to pass through the aperture and which cannot be retracted could equally be used. A shape comprising some form of apex or taper reduces the force needed to pass the coupling portion through the respective aperture.

The coupling portions may extend in a generally perpendicular direction with respect to the elongate axis of the central fencing wire securing portion. The direction may for example be arranged at slightly less or greater than 90 degrees with respect to the securing portion. The shape that the central fencing wire securing portion makes with the coupling portions may be generally U-shaped. Such a configuration facilitates insertion of the coupling portions into the apertures, allows for the retaining member to be firmly secured when the coupling portions penetrate the apertures and allows the clearance between the metal fence post and central fencing wire securing portion to be conveniently set.

Each of the coupling portions may comprise a first portion connected to and extending away from the central fencing wire securing portion and a second distal portion extending towards the central fencing wire securing portion. This is sometimes called a barb and may be regarded as hook-shaped. The coupling portions may for example be formed of a resilient material. While penetrating the coupling portion through the apertures the first and second portions may deflect towards each other allowing insertion through the aperture and then return to their original position after penetrating the aperture thereby preventing retraction of the coupling portions through the apertures. Such a configuration conveniently allows for the coupling portions to easily penetrate the apertures and be prevented from being removed through the apertures. The first and second portions may for example form a U or V shape. For example, the coupling portions may extend away from the central fencing wire securing portion with their ends pointing or facing back towards the central fencing wire securing portion in an inverted V-shape, with one end of the inverted V being connected to the central fencing wire securing portion. The terms "extending towards" and "extending away from" do not necessarily mean that the portions point directly towards or away from the central fencing wire securing portion and may merely mean a general relative sense of nearer and further away from.

Each of the coupling portions may have an angle of less than 90 degrees between the first portion and the central fencing wire securing portion. Such a configuration facilitates the penetration of the coupling portions into the apertures. The angle may for example be selected to optimise the force require to penetrate the coupling portions into the apertures.

In some examples, the retaining clip may be in the form of an elongate line having a straight central portion and two generally V-shaped portions at either end thereof wherein the apexes of the two V-shaped portions extend in the same direction away from the straight central portion. The term "same direction" may for example not imply that the two generally V-shaped portions point in exactly the same direction and may merely imply the same general direction for example when each of the coupling portions have an angle of less than 90 degree to the central fencing wire securing portion. The V-shape may for example have a curved region between the two straight portions of the V. Such a configuration conveniently allows for the coupling portions to easily penetrate the apertures and be prevented from being retracted through the apertures while allowing for ease of manufacture.

The rigidity of the coupling portions may be set such as to allow a user to cause the coupling portions to penetrate through the apertures of the metal fence post using hand force. This rigidity may for example be optimised by varying the cross-section or material of the coupling portions. Such a configuration allows fencing wire to be secured to the metal fence post by hand without the use of tools. This may for example be achieved by pressure applied by a thumb to the retaining clip.

In use, one side of the coupling portion deflects in a first direction when penetrating an aperture of a metal fence post and returns in an opposing second direction to an undeflected position once the free distal end of the coupling portion has passed through the aperture. Such a configuration allows the coupling portion to penetrate through the aperture while ensuring that once penetrated the coupling portion cannot be retracted back through the aperture. This is sometimes called a "snap-fit" connection and is described in more detail below.

A dimension of part of each coupling portion has a size that is larger than each aperture such that on insertion into the aperture the coupling portion is caused to be compressed so as to fit through the aperture but cannot be pulled back out of the aperture. The opposing coupling portion (that is on the other end of the wire securing portion) may be identical so as to deflect in the same manner. In another arrangement the coupling portions may be dissimilar, for example a coupling portion as described above on one end and an alternative hook or protrusion which is arranged to engage with an aperture. According to such an arrangement the hook or protrusion may be inserted into a first aperture and then the opposing coupling portion (having a shape described above) may be pushed into a second aperture and locked into place by the "snap-fit" arrangement.

The cross-section profile and material selection for the metal posts may be selected so that the posts are sufficiently rigid to prevent deflection of the post when at least one of the two coupling portions penetrates an aperture of the metal fence post. This may be achieved by selecting an appropriate metal material to form the metal post or by suitable reinforcement.

The material selected for the retaining clip may also be optimised to control the force required to push the coupling portion through the aperture.

To further enhance the life of the metal posts the posts (and clips) may be treated with a coating to prevent rusting. One suitable coating is a zinc coating which is economical to apply and prolongs the life of carbon steels in a wet or moist environment.

Increasing the stiffness of the material used for the clip will increase the force needed to deflect the clip and thus the force the assembler needs to apply to the clip to force it through the aperture. This provides a high strength coupling.

Conversely reducing the stiffness of the material reduces the force needed to form the coupling between clip and post but reduces the strength of the coupling.

In an example the post may be formed of cold forming grade steel galvanised with a minimum of 500 g/m$^2$ of zinc (or equivalent coating quality).

In an example, the clip may be formed of either stainless steel to BS EN 10270-3 (1-4310) or galvanised spring steel to BS EN 10270-1 SH (G).

The apertures formed through the post have a distribution which is commensurate with the spacing of the coupling portions of the clip so as to allow the two to cooperate and retain the fencing wire.

The apertures may be uniformly spaced along the post or may have different grouped distributions.

All or a subset of the plurality of discrete apertures formed on the post may have a pitch of between 40 mm and 50 mm. The term "pitch" is used in the sense of the distance between successive points, in this case the distance between the centres of adjacent discrete apertures. Such a configuration allows a variety of conventional net fencing wire-pitches to be secured to the metal fence posts in a secure manner whilst simultaneously allowing for easy construction of the fence over varied terrain. Additionally, the flexibility provided by the apertures allows different fencing wires to be used along the same length of fencing.

The apertures formed on the post may be any suitable shape to receive and retain the coupling portions of the retaining clips. In some examples, the apertures may be circular. Such a configuration is easy to manufacture and can allow for free rotation of a retaining clip located in the aperture. This provides further flexibility when assembling the fencing system, in particular, over non-uniform or undulating terrain.

Alternatively in some examples, the apertures may be rectangular. By providing a rectangular aperture more than one coupling portions of a clip can be allowed to penetrate the same aperture by virtue of the width provided by the rectangular aperture. This may also act to restrict rotation of the retaining clip(s).

A portion of each of the apertures may be chamfered such that the chamfer cooperates with the coupling portions of the retaining clip facing the chamfer as the clip is inserted. Such a configuration allows for easy penetration of the coupling portion into the aperture. By providing a chamfer, deflection of the coupling portion (as it passes through the aperture) can be facilitated. This reduces the force required to pass the retaining portion through the aperture and additionally reduces damage/wear on the coupling portion as it engages with the metal post.

All or some of the apertures may be arranged in a straight line along the length of the metal fence post. The apertures each provide a point where one or more clips may be engaged such that a portion of the fencing wire can be secured between apertures. This allows different wire mesh spacings to be accommodated by the fencing system. It also allows for flexibility in where the retaining clips are located.

In some examples, the apertures (or a subset) may be arranged as a pair of adjacent lines extending along the length of the metal post. Such a configuration further increases the flexibility of the fencing system by providing more combinations of locations for clip engagement. For example, two lines of apertures allow the clips to be located either vertically, horizontally or at an angle to the vertical e.g. 45 degrees. This provides still further flexibility to the fence system installer.

In some examples, each aperture may be of a sufficient size to receive a coupling portion from two separate retaining clips at the same time. Such a configuration allows one aperture to secure two clips which in turn allows for increased flexibility in the locations at which the fencing wires are connected to the post and also the strength of the connection. This configuration allows two clips to be retaining in three apertures when the wire securing portion of each clip extends in opposing directions e.g. one up and one down.

Alternatively or additionally clips may be inserted in pairs with each end of the respective clip engaging with the same aperture. In effect such an aperture size means that clips can be "doubled-up" to provide additional strength for example in high loading applications.

In some examples, the apertures may be adapted to engage with the coupling portion so as to restrict or limit the free rotation of the coupling portion relative to an aperture. The rotation may, for example, be restricted by the apertures taking the form of a slot such that the clip coupling portion can only be located in a particular orientation with respect to the aperture. Such a configuration can assist the user during installation, specifically the insertion process of the retaining clip, by holding the clip in place after one coupling portion has penetrated an aperture. This can allow the user to insert the clip one-handed because unlike a circular aperture the slot does not allow the clip to rotate when one or both coupling portions are partially located in the slot.

The apertures in the metal post may be formed in a number of different ways. In some examples, the apertures may be in the form of punched holes penetrating a wall of the metal fence post. Forming the holes in this manner allows for high speed and low-cost manufacturing.

Alternatively, the apertures may be in the form of drilled holes penetrating a wall of the metal fence post. Forming the holes in this manner allows for high precision manufacturing.

The metal fence post may further comprise a surface against which fencing wire may be secured. The fencing wire may be secured to the metal fence post by securing a portion of fencing wire against a rigid surface of the metal post on one side of the wire and against the wire securing portion of the clip on the other side. The portion of fencing wire is secured between the two.

The surface of the metal post against which the wire is secured may be adapted to restrict or facilitate the movement of the wire across its surface. For example, the surface and/or central fencing wire securing portion may be roughened to increase friction or smoothed to reduce friction. This may be achieved through material selection for the clip and metal post or through a coating. The coefficient of friction may be selected so as to be different for different directions, for example a high coefficient of friction may be desired in a vertical direction to prevent the wire moving up and down but lower in a horizontal direction to allow the wire fence to be strained (placed in tension). The combination of materials for the surface and central fencing wire securing portion may be selected on the basis of their coefficient of friction with the fencing wire.

In a conventional arrangement the surface of the elongate metal post is provided with the plurality of apertures. Alternatively, a number of the faces may be provided with apertures enhancing the options for connecting wire mesh against different surfaces of the post.

A portion of the metal fence post may extend in a direction generally perpendicular to the face of the surface. The face of the post containing the apertures is supported by the structure of the post to provide the desired structural strength in terms of rigidity and bending strength. This strength may be provided in a number of ways. For example, the post may be in the form of a metal plate having sufficient thickness to support the wire fence under tension. However, to reduce cost and optimise strength the post may be in the form of a closed or open and hollow elongate metal prism with one face of the prism containing the apertures.

In a simple form the metal post may be an elongate U shape (viewed in cross-section) with a length commensurate with a desired application (determined for example by the stock to be restrained). In such an arrangement the wire may be coupled to any of the 3 faces of the post (as discussed above). To optimise strength, the bottom surface of the "U" may (that is the face between the two perpendicularly extending faces) define the surface against which the wire is located and secured and through which the apertures are formed.

The metal fence post may be in the form of an elongate member having an outer metal perimeter defining a closed perimeter (i.e. where the perimeter extends all of the away around the post) or partially closed perimeter (i.e. where the perimeter does not extend all of the way around the post). In each case the centre of the post is hollow.

The apertures are arranged along at least one face of the metal perimeter. Creating a hollow post in such a configuration increases the second moment of area, strengthening the post. It additionally minimises the material used for a given structural strength. In a partially closed cross-section the inner surfaces of the post can be accessed thereby allowing the clips to be removed from the back to disassemble the fence system. Furthermore, the open side of the post allows easy access to the inside of the metal fence post and may allow inserted retaining clips to be straightforwardly cut or otherwise manipulated. The open face may also allow for easy insertion of a reinforcement member and may allow such a reinforcement member to be positioned in-use partially inside and outside the metal fence post.

In such an open post arrangement (that is where the material is rolled around to form a generally U shape profile) the open face between the pair of vertical sides of the post can be considered to define a slot.

The elongate metal post may for example be formed by rolling, bending or extrusion allowing the metal fence to be easily and cheaply produced. Such a configuration allows for the metal fence post to have a uniform strength along its length and facilitates efficient stacking during transportation and storage.

The cross-section of the metal post may be selected from a variety of shapes depending on the application. In some examples, the post may be a triangular prism which may be used as a corner post application.

Alternatively, in some examples, the metal post may be a rectangular prism. Such a configuration allows for the metal fence post to be strong relative to the amount of material used while being simple to construct. It will be recognised that other cross-sections such as squares, circles (i.e. a tube shaped elongate member) or other geometrical shapes may be employed.

The metal fence post may be formed using conventional manufacturing techniques such as sheet metal bent or rolled into a generally U-shaped cross-section. The rolling may for example be cold or hot rolling. Thus, low cost simple manufacture can be employed for the metal post manufacturing process.

The metal fence post may comprise a pair of channels extending along at least part of the length of the post for receiving a reinforcement member. The channels may for example be formed by forming the post wall in such a way that the wall folds back on itself to define a channel between two adjacent portions of the wall. The channels may for example be manufactured by rolling, bending or extrusion in an integral manner with the rest of the metal fence post. These channels may, for example, take the form of two U-shaped portions. Such a configuration of channels allows for the reinforcement member to be firmly located and retained within the metal fence post, allows for the strength of the metal fence post to be optimised and reduces a risk of injuring a user's hands from potentially sharp edges of the metal fence post.

As described herein, the plurality of clips co-operate with and penetrate the apertures to secure the wire fence against the metal post. When the clip is in-situ each clip forces the wire against the surface of the metal post. The space defined between the face of the metal post containing the apertures and the side of the wire securing portion of the clip facing the post is defined by the shape of the coupling portions at either end of the wire securing portion. A plurality of different spaces may be provided by respective clips so as to allow a user to select the force to be applied to the wire against the post. The smaller the space, the greater the compressive force acting on the fencing wire when the clip is installed. Appropriately selecting the spacing at different locations allows some parts of the fencing wire to be held more firmly against the metal post than others.

In some examples, one or more of the metal fence posts may be configured to receive a reinforcing member (as discussed above). Conveniently this allows for the same fence posts to be used both as regular and strainer posts, as well as allowing the same fence posts to be used for a variety of loads that may be applied by different livestock or the like, while avoiding the need to make the posts excessively strong and/or rigid. A strainer post is a post, usually at the end of a length of wire fencing, against which the wire fencing is strained taut. Accordingly, this allows for economies of scale in the manufacture of the fence posts hence reducing manufacturing costs.

In some examples, the reinforcing member may be an I-bar, or alternate shape reinforcement bar, connected to and/or located within one of the optionally similarly shaped channels discussed above, or simply within the hollow space within the post defined by the perimeter wall.

Such an I-bar may for example be a conventional commercially available I-beam. The channel may extend all or part of the way along the post. The shape of the hollow space or cavity within the post may for example be keyed (i.e. complementary in cross-section) to the shape of the I-bar. Thus, the I-bar is securely retained and positioned within the post. Such a configuration allows for the strength of the metal fence post/reinforcing member assembly to be optimised relative to the amount of material used while being easy to manufacture, and allows for a system where the user can conveniently slot a reinforcing member into a metal fence post to form a reinforced post in the fence. This may be required, for example, when a gateway is installed in the fence.

According to a second aspect of the teachings there is provided a metal fence post for receiving fencing wire comprising a surface against which fencing wire may be secured and a plurality of discrete apertures uniformly spaced along at least part of the length of the surface. A portion of the metal fence post extends in a direction generally perpendicular to the face of the surface.

By this approach, a metal fence post for receiving fencing wire is provided which allows for metal to be used while being straightforward to assemble and erect. The use of metal fence posts allows a system in which they are employed to be durable and avoids the need for the use of treatment chemicals while providing for a low life-time cost.

The metal fence post may be in the form of an elongate member comprising an outer metal perimeter and an inner hollow region and the apertures may be arranged along at least one face of the metal perimeter.

According to a third aspect of the teachings there is provided a retaining clip for a metal fence post. The clip comprises a central fencing wire securing portion and two opposing coupling portions arranged in use to cooperate with at least one aperture of a metal fence post. At least one of the two opposing coupling portions is arranged to deflect in a first direction when penetrating an aperture of the metal fence post and to return to an un-deflected position once through the aperture.

By this approach, a retaining clip is provided which allows for the use of metal fence posts thus increasing the durability and avoiding the use of chemical treatments in a system in which they are employed while allowing for straightforward securement of fencing wire.

According to an invention described herein the specially adapted retaining clip may for example be used in combination with a specially adapted metal post to provide a high integrity barrier which can be easily and quickly installed.

As stated above, each retaining clip comprises a central fencing wire securing portion and two opposing coupling portions. In effect, each clip may for example have a straight central portion which, in use, overlaps a portion of the wire to be restrained, and a coupling portion at either end. Thus, when each of the coupling portions is inserted into apertures of a metal fence post the wire is securely retained between the metal fence post (into which the coupling portions are inserted) and the central fencing wire securing portion.

By the two opposing coupling portions being arranged to deflect in a first direction when penetrating an aperture of the metal fence post and to return to an un-deflected position once through the aperture the configuration allows the coupling portion to be penetrated through the aperture while ensuring that once penetrated the coupling portion cannot be retracted back through the aperture. This is sometimes called a "snap-fit" connection. The coupling portions may have a size that is larger than the aperture such that on insertion into the aperture the coupling portion is caused to be compressed so as to fit through the aperture.

BRIEF DESCRIPTION OF DRAWINGS

The present teachings will now be described by way of example only and with reference to the following Figures in which.

Figure 1:
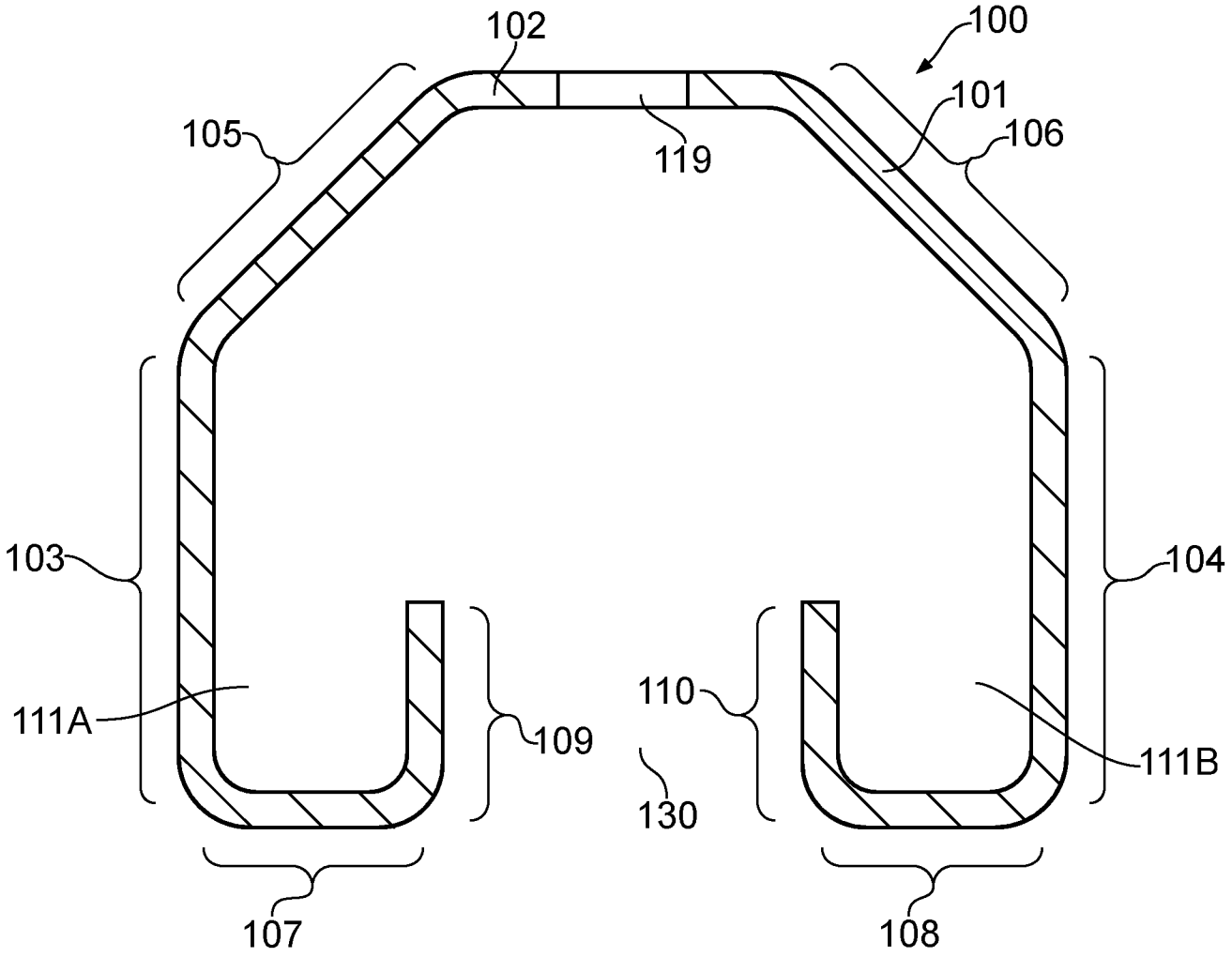
FIG. 1 shows an end view cross-section of a metal fence post.

While the invention is susceptible to various modifications and alternative forms, specific embodiments are shown by way of example in the drawings and are herein described in detail. It should be understood however that the drawings and detailed description attached hereto are not intended to limit the invention to the particular form disclosed but rather the invention is to cover all modifications, equivalents and alternatives falling within the spirit and scope of the appended claims.

DETAILED DESCRIPTION

FIG. 1 is a cross-section view through the metal fence post 100.

The metal post comprises a perimeter wall 101 defining a hollow space or cavity defined by the perimeter wall. The generally U shaped perimeter wall can be divided into the following regions

- a substantially flat upper surface 102;
- two substantially parallel side walls 103, 104;
- two connecting regions 105, 106 linking the flat surface 101 and the two side surfaces 103, 104;
- two substantially flat lower surfaces 107, 108; and
- two returning portions 109, 110.

Each of the surfaces serves a particular purpose as part of the fencing system described herein. Each of the surfaces extends in an elongate axis of the post, having a length defined by the desired length of the post for the specific application.

The flat upper surface 102 is the surface against which the fencing mesh or wire is located (as will be described in more detail below). The surface 102 comprises a plurality of apertures 119 which are spaced along the length of the post at a predetermined pitch or spacing (described further below).

It can be seen that the perimeter wall is a continuous piece of metal material that has been formed, for example by rolling, into the cross-section shown in FIG. 1. In an alternative arrangement each surface could be formed independently and then connected together by, for example, welding.

As shown in FIG. 1 the flat upper surface 102 is connected to the two side surfaces 103, 104 by angle surfaces 105, 106. In FIG. 1 these extend at approximately 45 degrees to the upper surface. Selecting the length of the upper surface determines the length of the angled surfaces 105, 106. In an arrangement where the flat surface is very wide the angled surfaces 105, 106 may be very short or even simply chamfered edges leading the upper surface into the two side surfaces. The precise geometry can be selected according to the desired strength for an application.

At the opposing end of the side surfaces 103, 104 (to the upper surface) two lower surfaces 107, 108 are formed, these surfaces being generally parallel with the upper surface. The lower surface (and the returning surfaces or portions 109, 110 are optional but further increase the rigidity of the fence post.

The returning surfaces or portions 109, 110 are generally parallel with the side surfaces 103, 104 and extend a predetermined distance into the hollow inner region of the post. The returning surfaces also conveniently define two channels 111A, 111B on opposing sides of the opening (or slot) 130.

The channels 111A and 111B provide a guide into which a reinforcing member may be inserted. This is described further below.

The opening or slot 130 allows for access into the hollow region of the post so that the clips (described below) can be released if the fence needs to be disassembled.

The cross-section of the post may vary according to the loading requirements of the given application. This may additionally involve increasing or decreasing the thickness of the perimeter wall and/or selecting particular materials.

The fence post may additionally be provided with a zinc dipped or other coating on both inner and outer surfaces.

Figure 2:
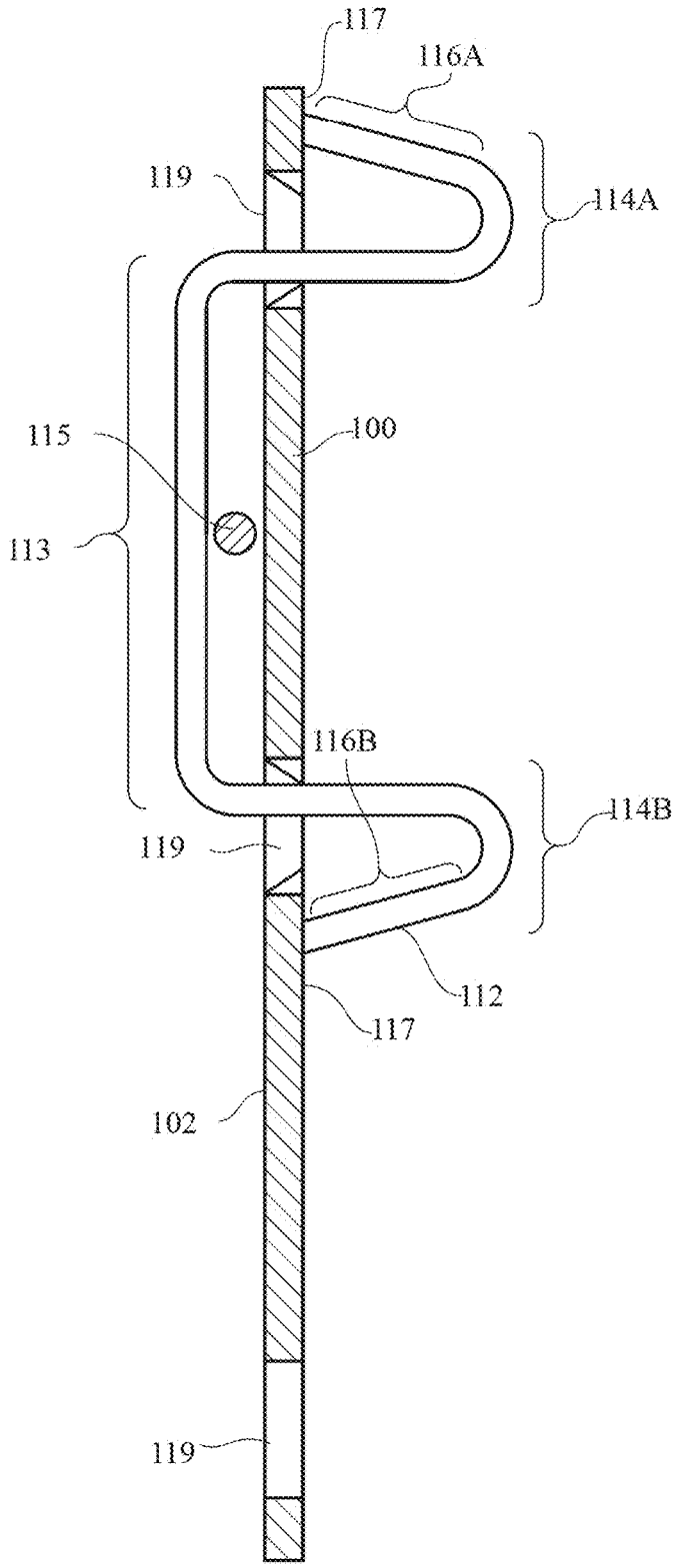
FIG. 2 shows a lengthwise cross-section of a metal fence post with a penetrated retaining clip.

FIG. 2 shows a retaining clip 112 according to an invention which has been installed in the flat upper surface 102 described above. The metal post 100 is in a vertical orientation as it would be in use and is shown in cross-section along the centre of the post in alignment with the plurality of apertures 119.

As shown in FIG. 2 a retaining clip 112 is located in the post 100. Only one clip 112 is shown but it will be recognised that clips can be inserted into each of the apertures.

The retaining clip 112 comprises three regions or portions: a central fencing wire securing portion 113 and two opposing coupling portions 114A and 114B located at either end of the central portion 113. The clip is formed of a single length of metal wire made from either stainless steel to BS EN 10270-3 (1-4310) or galvanised spring steel to BS EN 10270-1 SH (G) which has been bent into the general shape shown in FIG. 2.

It will be recognised that the precise geometry of the clip may differ. The important features are the three regions.

There are two coupling portions 114A, 114B at opposing ends of the central region 113 which are in the form of U-shaped portions with the apex of each U extending away from the central region 113. It will be recognised that as the apex of each U is brought into contact with the aperture 119 the distal ends 116A, 116B of the wire forming the coupling portions are caused to deflect. As force is applied to the central region 113 the distal ends 116A, 116B both deflect towards each other reducing the width of each coupling portion 114A, 114B such that each coupling portion can penetrate and pass through the respective aperture 119. As illustrated in FIG. 2, a portion of the aperture 119 can be chamfered, such that the chamfer cooperates with the two opposing coupling portions of the retaining claim 112.

As shown in FIG. 2 the clip has been pushed against the post such that the above deflection occurs. Because of the elastic property of the material forming the clip, each of the coupling portions 114A and 114B returns to its original un-deflected position once through the aperture. As shown, the two distal portions 116A and 116B are then in abutment with the inner surface of the post 117. This prevents the clip from being retracted through the aperture and thereby restrains the wire 115 against the outer surface of the post (the upper flat surface 102 described above with reference to the post in isolation).

Attaching a plurality of clips to the post can thereby restrain a wire mesh against the post to form the fencing system. It will be recognised that the clip and apertures advantageously allow the mesh to be restrained with ease without bespoke or specialised tooling. The system can also be used very quickly owing to the clip arrangement.

Figure 11:
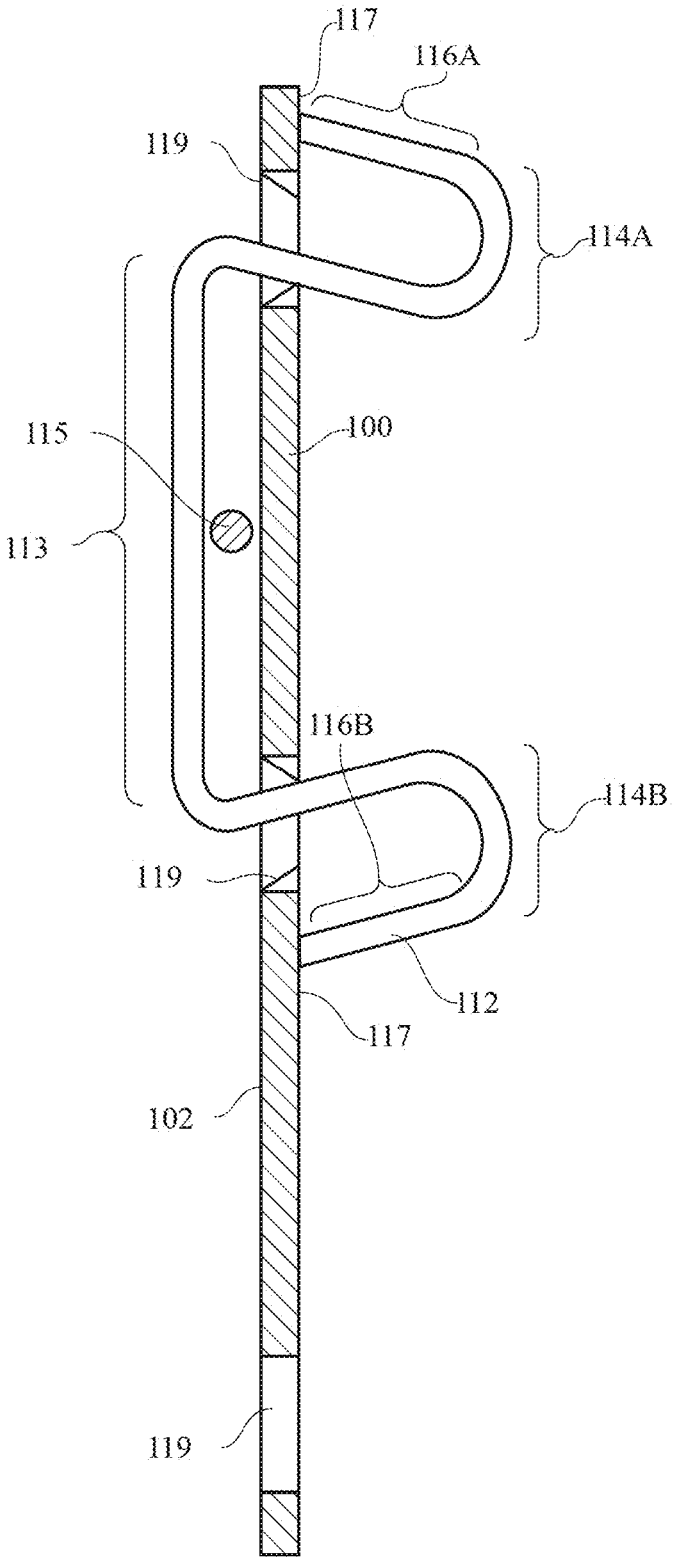
FIG. 11 is similar to FIG. 2, except that the retaining clip has an angle that is less than 90 degrees.

FIG. 11 is similar to FIG. 2, except that the retaining clip 112 has an angle that is less than 90 degrees. Specifically, as illustrated in FIG. 11, each of the coupling portions 114A, 114B has an angle of less than 90 degrees between the first portion and the central region (e.g., the central fencing wire securing portion) 113.

Figure 3:
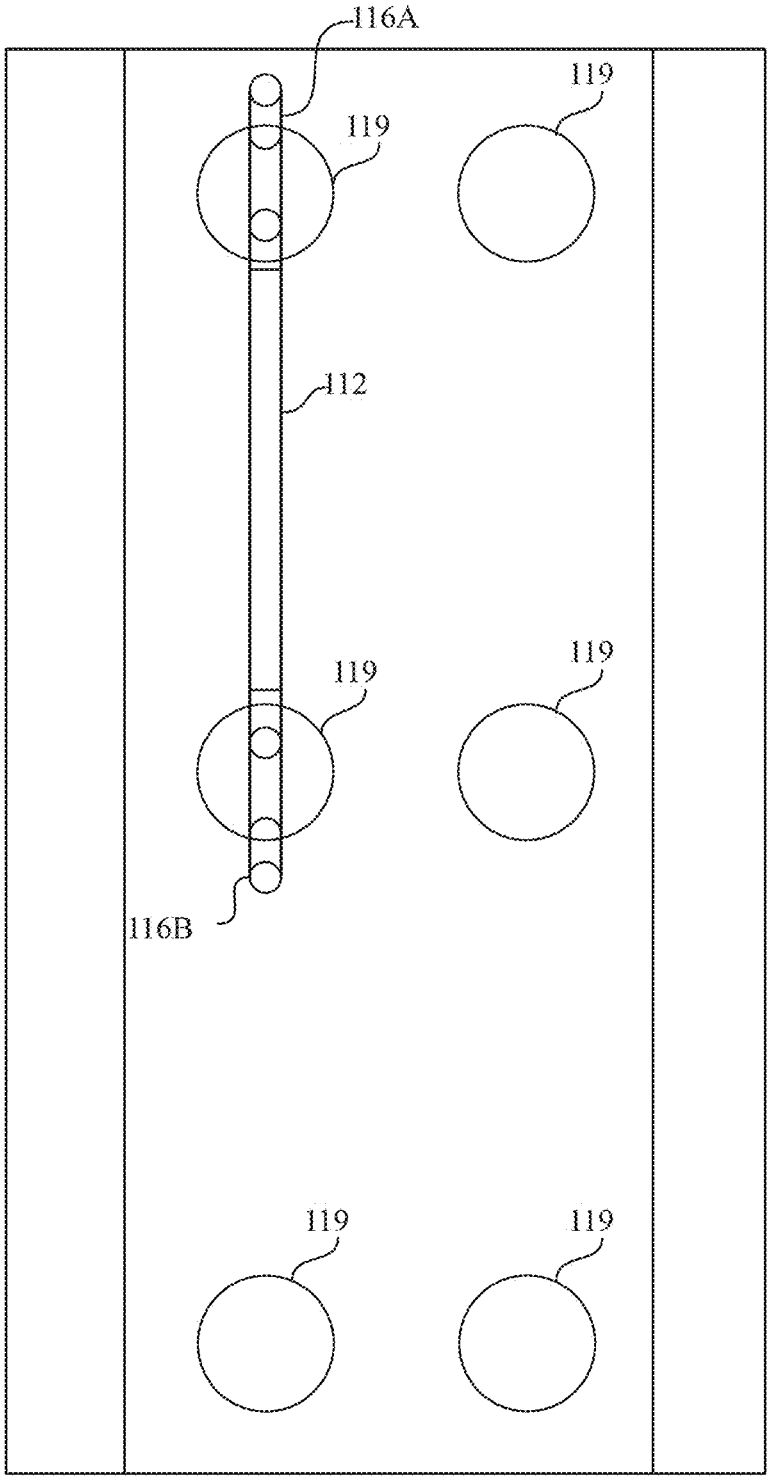
FIG. 3 shows a front view of a metal fence post with a penetrated retaining clip.

FIG. 3 is a front view of a post illustrating the positions of the distal ends 116A, 116B which have passed through the apertures 119. As shown, the distal end of each coupling portion 114A, 114B is outside of the area defined by each aperture and therefore cannot be retracted through the aperture. As illustrated, at least a subset of the apertures 119 can be arranged in two lines. For example, there is a vertical line of three apertures 119 on the left-hand side and another vertical line of three apertures 119 on the right-hand side.

Figure 10:
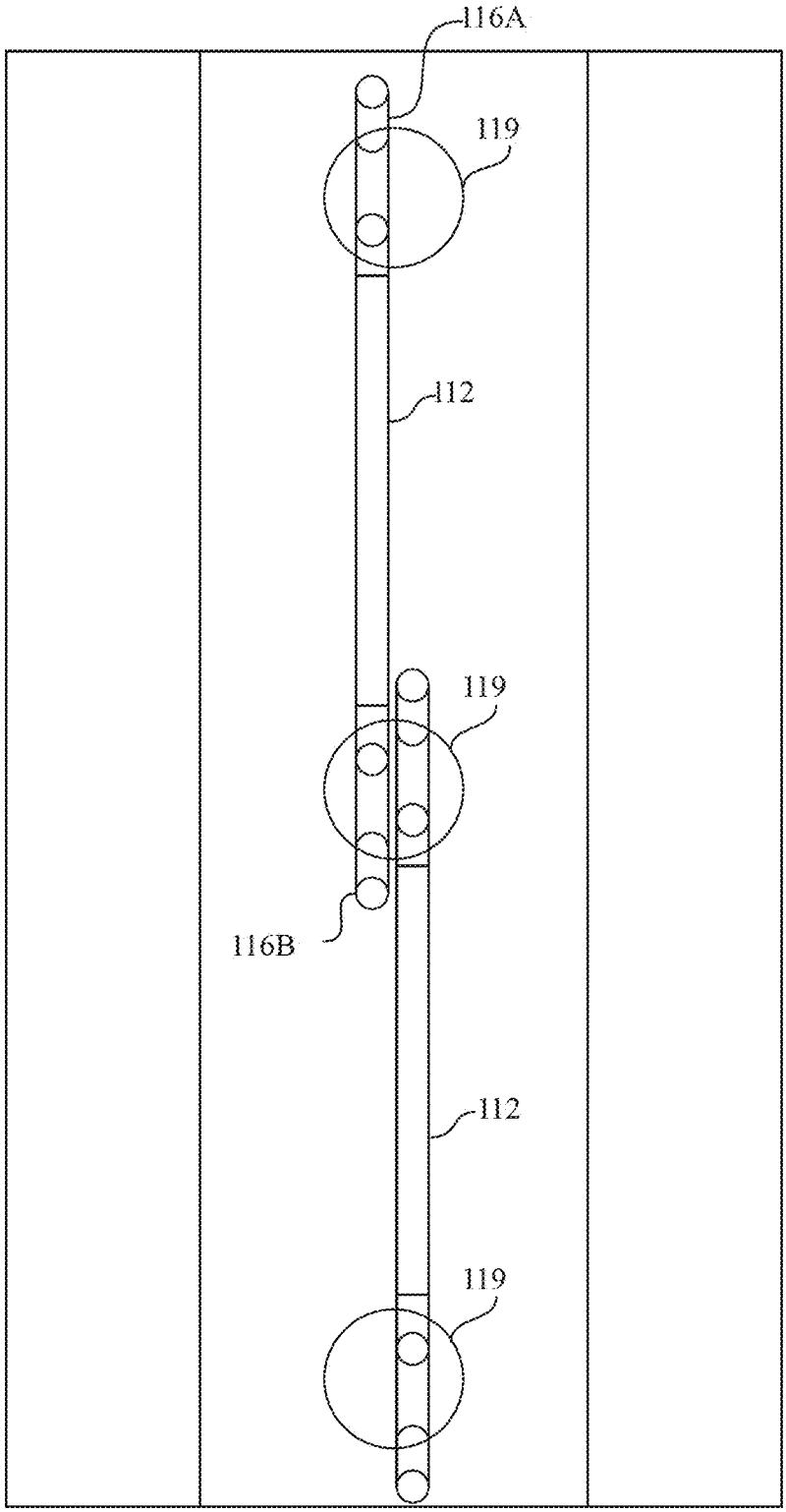
FIG. 10 is similar to FIG. 3, except that two penetrated retaining clips are illustrated.

FIG. 10 is similar to FIG. 3, except that two penetrated retaining clips are illustrated. Specifically, FIG. 10 illustrates two retaining clips 112, wherein the top retaining clip 112 passes through the top aperture 119 and the middle aperture 119 and the bottom retaining clip 112 passes through the middle aperture 119 and the bottom aperture 119. As illustrated, in FIG. 10, each aperture 112 is of a sufficient size to accept one coupling portion from each of two retaining clips 112 at a same time (e.g., the middle aperture 119 has accepted two retaining clips 112).

Figure 4:
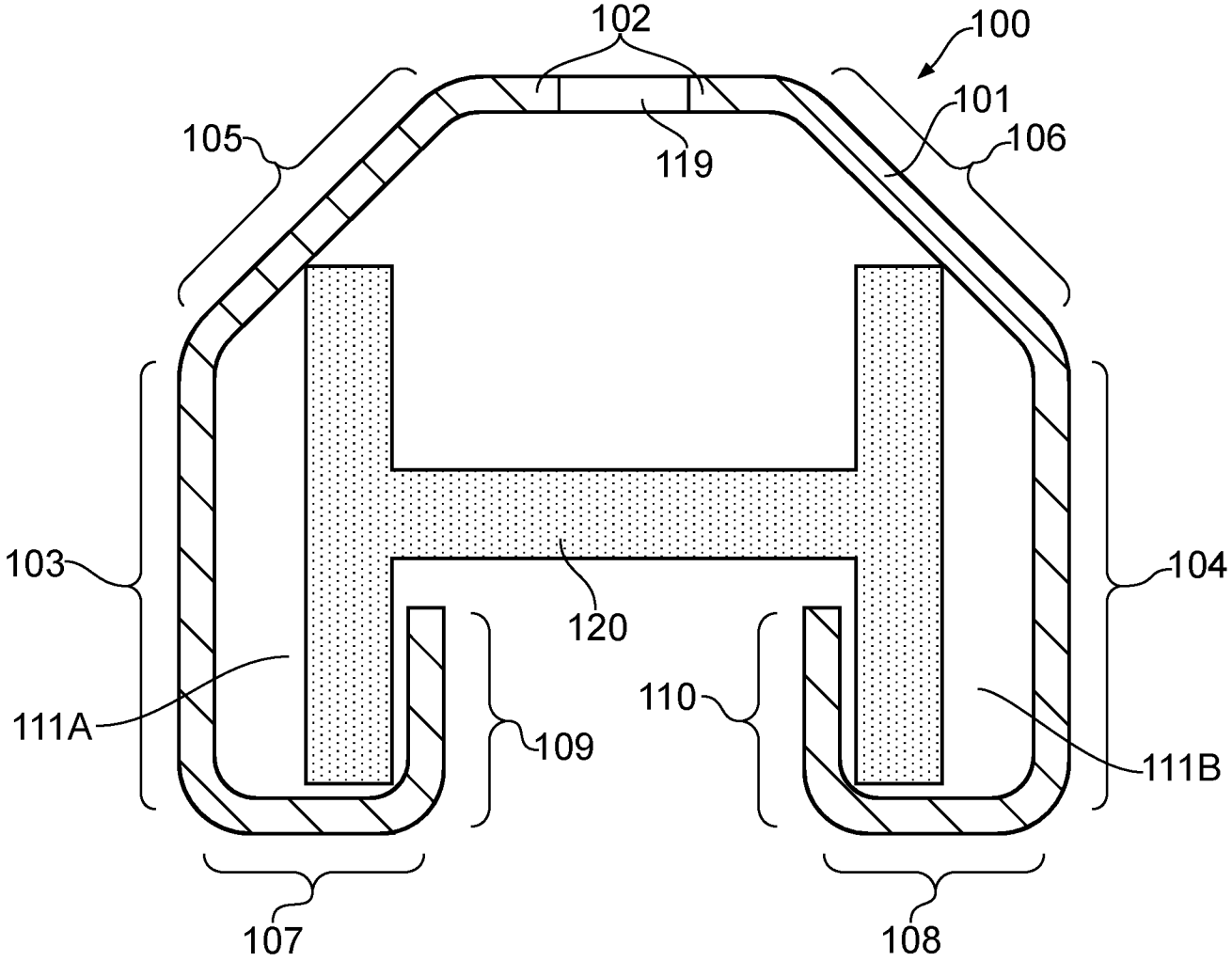
FIG. 4 shows an end view of a metal fence post with a reinforcement member inserted.

FIG. 4 is a plan view of a metal post incorporating a reinforcement member 120. In the example shown the reinforcement member 120 is in the form of an I-beam, the sides of which engage with the channels 111A, 111B shown in FIG. 1. A reinforced post of this kind can for example be used as a strainer post with greater rigidity than posts not comprising a reinforcement member.

Figure 5:
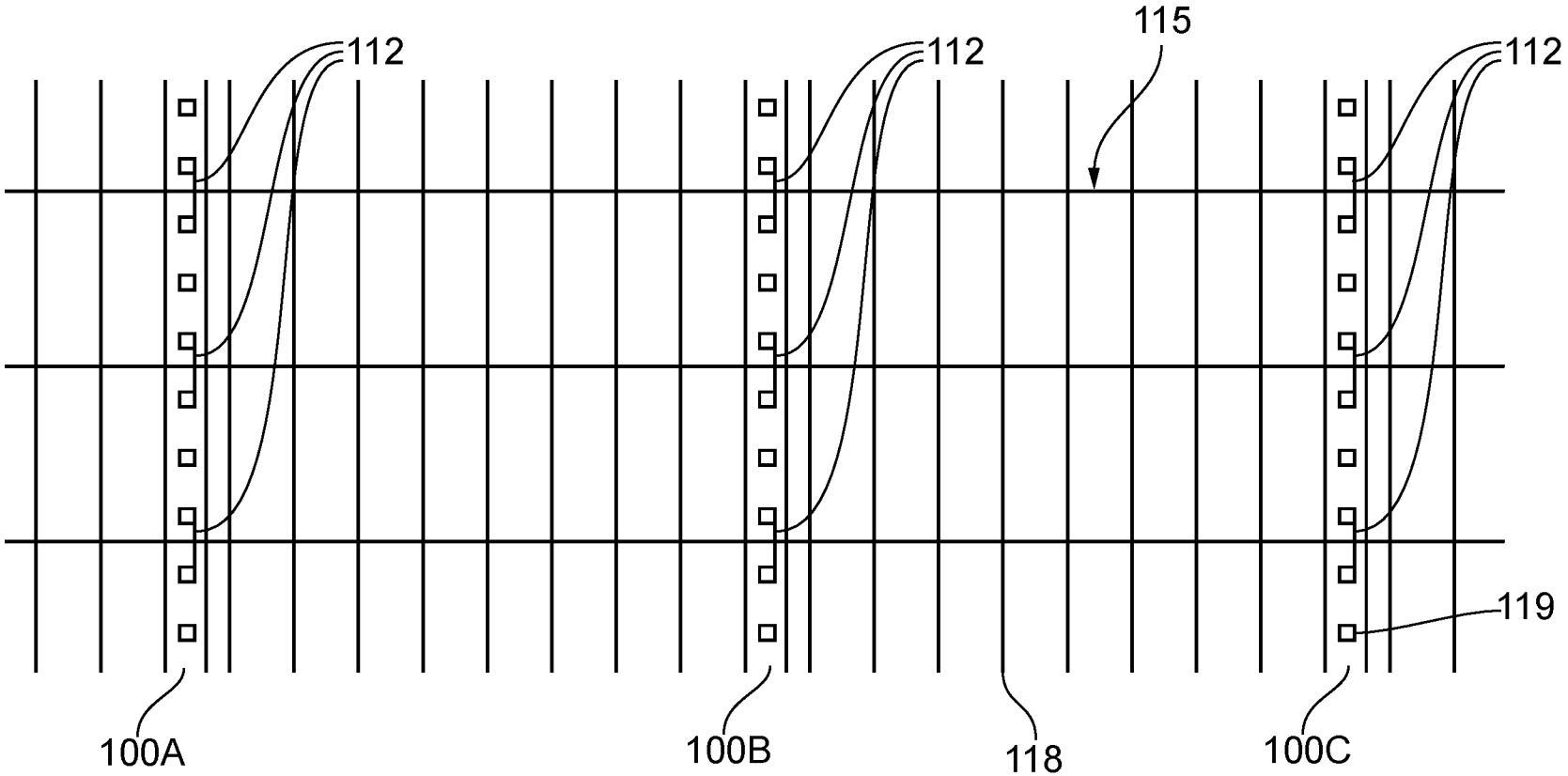
FIG. 5 shows an example of an assembled metal fencing system.

FIG. 5 shows a section of the fencing system and a length of wire mesh fencing 118 attached to the posts.

A plurality of posts 100A, 100B, 100C are shown, each comprising a plurality of apertures 119 uniformly spaced along the posts. As shown a plurality of clips 112 have been pushed into the apertures 119 and the wire mesh fencing 118 is thereby restrained against the posts 100A, 100B, 100C.

Figure 6:
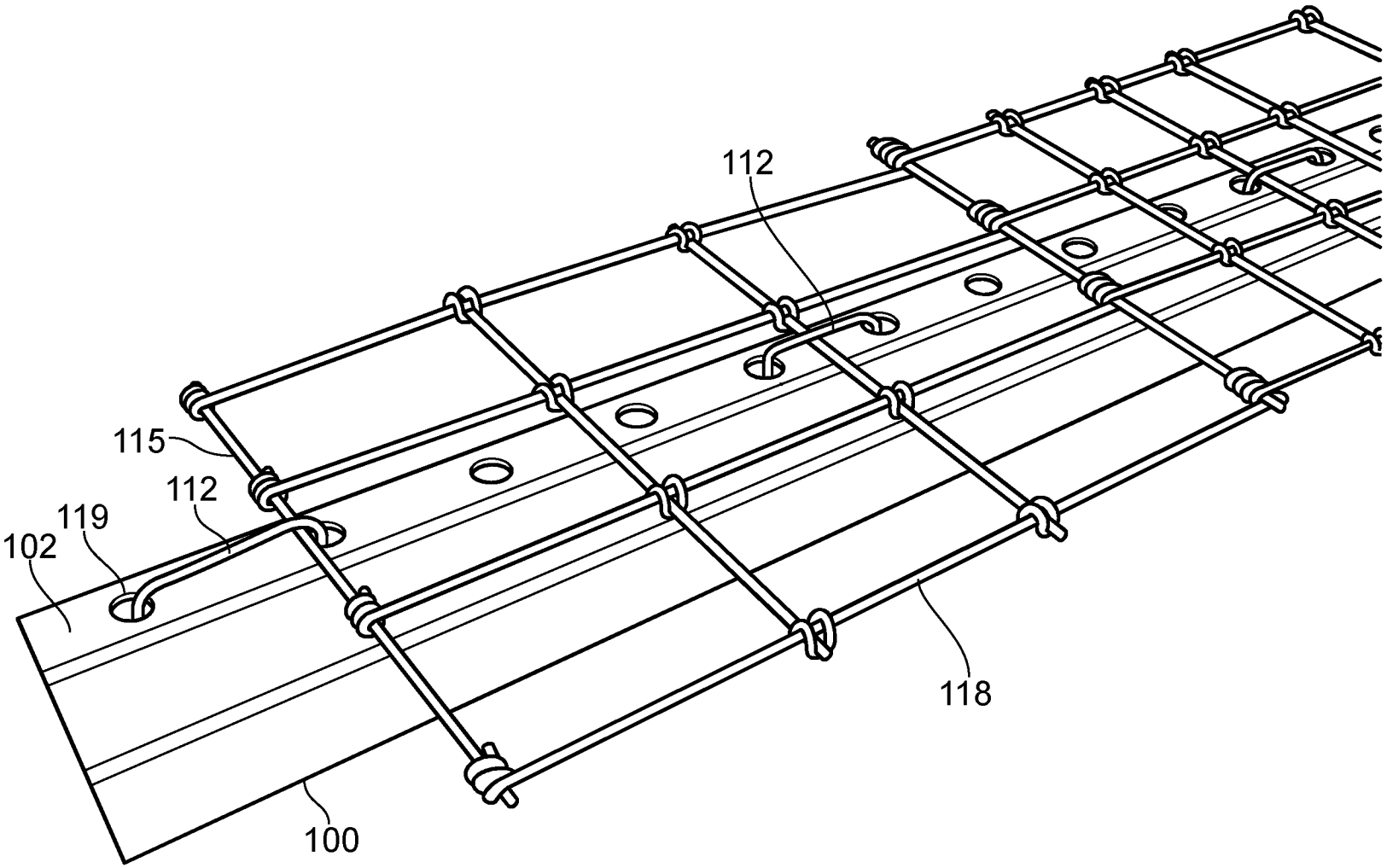
FIG. 6 shows a photograph of a perspective view of a metal fence post, retaining clips and fencing wire assembly.

FIG. 6 shows a single post 100 and a section of metal fencing wire 118 attached to the post 100 with the clips 112 of the invention. As shown the plurality of apertures 119 allow for great flexibility in which portions of the wire mesh 118 can be coupled to the post 100. As illustrated in FIG. 6 the particular section of mesh 118 has varying size spacings of wire 115. This can still be accommodated by the present fencing system by virtue of the plurality of apertures 119 and clips 112. The right hand side of the photograph shows smaller mesh squares than the left hand end of the section and both are still conveniently coupled to the post 100 by means of the plurality of clips 112.

Figure 7:
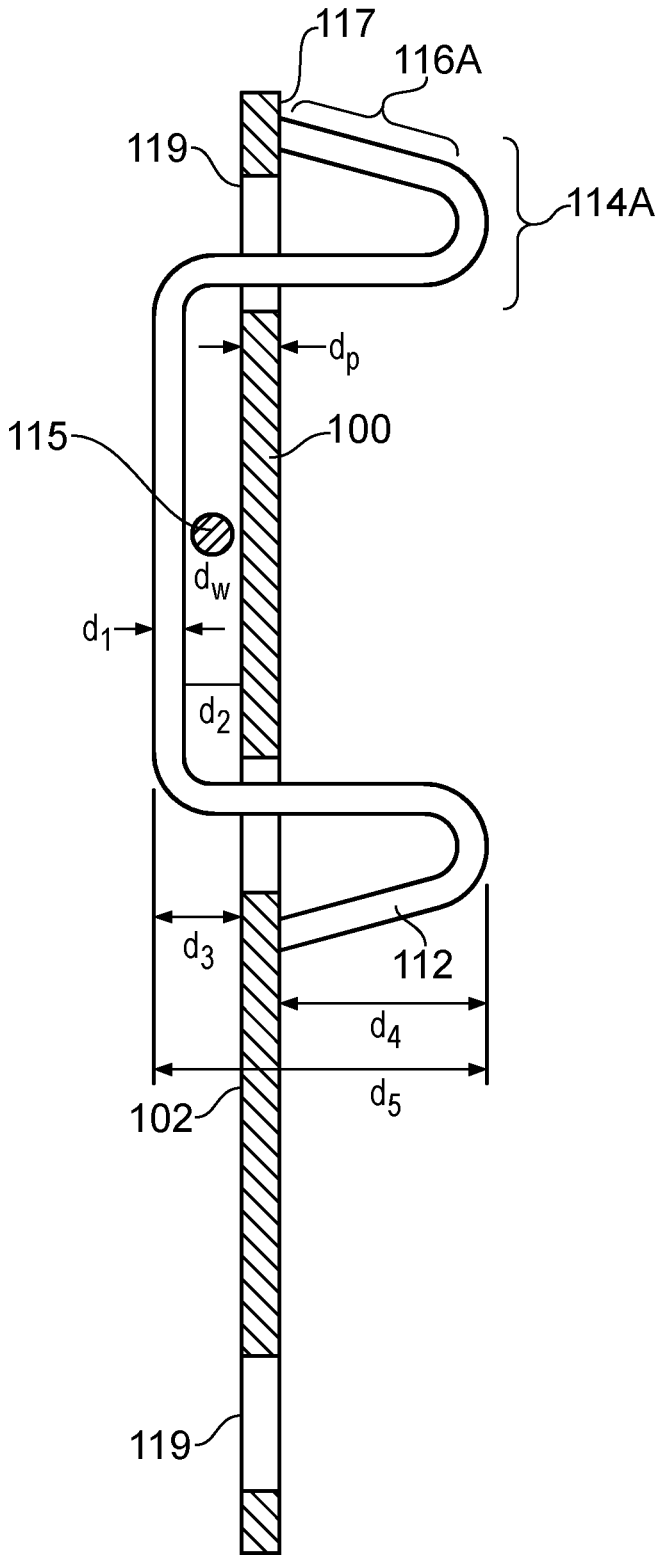
FIG. 7 shows a lengthwise cross-section of a metal fence post with a penetrated retaining clip illustrating the dimension considerations of the retaining clip.

FIG. 7 illustrates example dimensions for the clip 112 in which:

$d_w$=2.50 mm
$d_p$=2.50 mm
$d_1$=2.35 mm
$d_2$=4.27 mm
$d_3$=6.62 mm
$d_4$=15.90 mm
$d_5$=25.02 mm

For a given wire fence mesh using a wire diameter of $d_w$ the following relationship (labelled as equation 6 with preceding derivation steps 1-5) is required to ensure that (a) the clip can penetrate the apertures and (b) that the wire can be secured to the post:

$$d_2 \geq d_w \quad (1)$$

$$d_3 = d_1 + d_2 \quad (2)$$

$$d_5 = d_3 + d_4 + d_p \quad (3)$$

$$d_5 = d_1 + d_2 + d_4 + d_p \quad (4)$$

$$d_2 = d_5 - d_1 - d_4 - d_p \quad (5)$$

$$d_w \geq d_5 - d_1 - d_4 - d_p \quad (6)$$

Figure 8B:
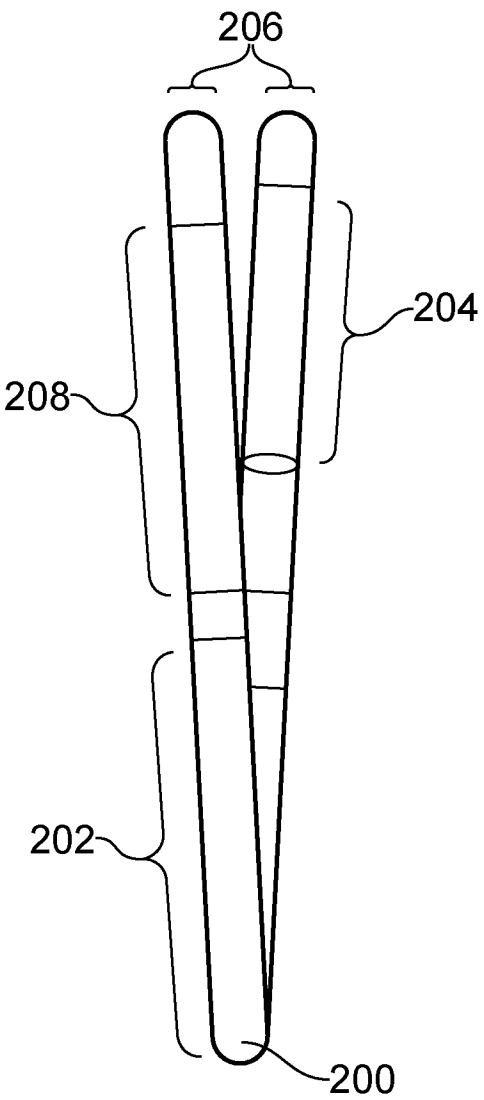
FIGS. 8A, 8B show a line wire retaining clip in front view, FIG. 8A, and side view, FIG. 8B.
Figure 8A:
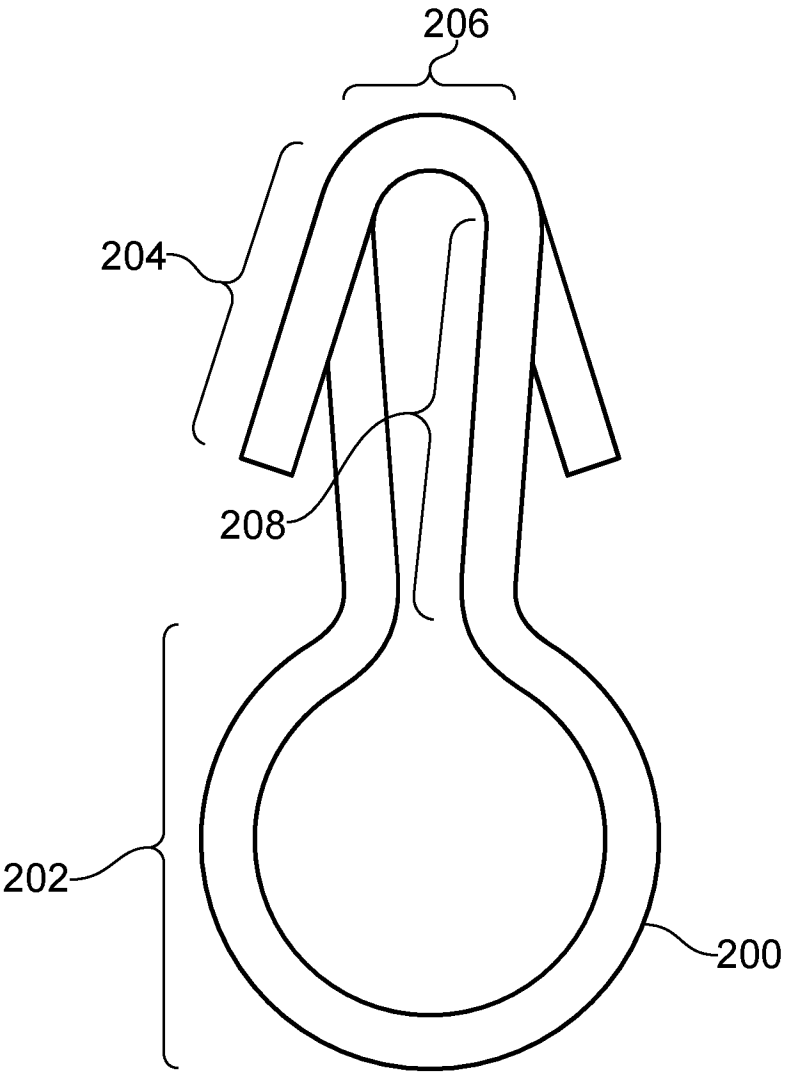

FIGS. 8A and 8B show a line wire retaining clip 200 in front view, FIG. 8A, and side view, FIG. 8B.

The line wire retaining clip 200 comprises 3 regions or portions: a central line wire securing portion 202 and two opposing coupling portions 206. The clip is formed of a single length of metal wire made from stainless steel to BS EN 10270-3 (1-4310), galvanised spring steel to BS EN 10270-1 SH (G) or similar which has been bent into the general shape shown in FIGS. 8A, 8B.

In the present example, central line wire securing portion 202 has a substantially circular "loop" shape. In other implementations, central line wire securing portion 202 may be ovoid, rectangular or any other suitable shape according to the requirements of the implementation.

The two coupling portions 206 are disposed at opposing ends of the central fencing wire securing portion 202 and are formed of distal portion 204 and proximal portion 208. In the present example, the coupling portions 206 are in the form of U-shaped portions with the apex of each U extending away from the central line wire securing portion 202. In other implementations, the two coupling portions 206 may be V-shaped or any other suitable shape according to the requirements of the implementation.

It will be recognised that the precise geometry of the line wire retaining clip 200 may differ. The important features are the three regions.

Figure 9:
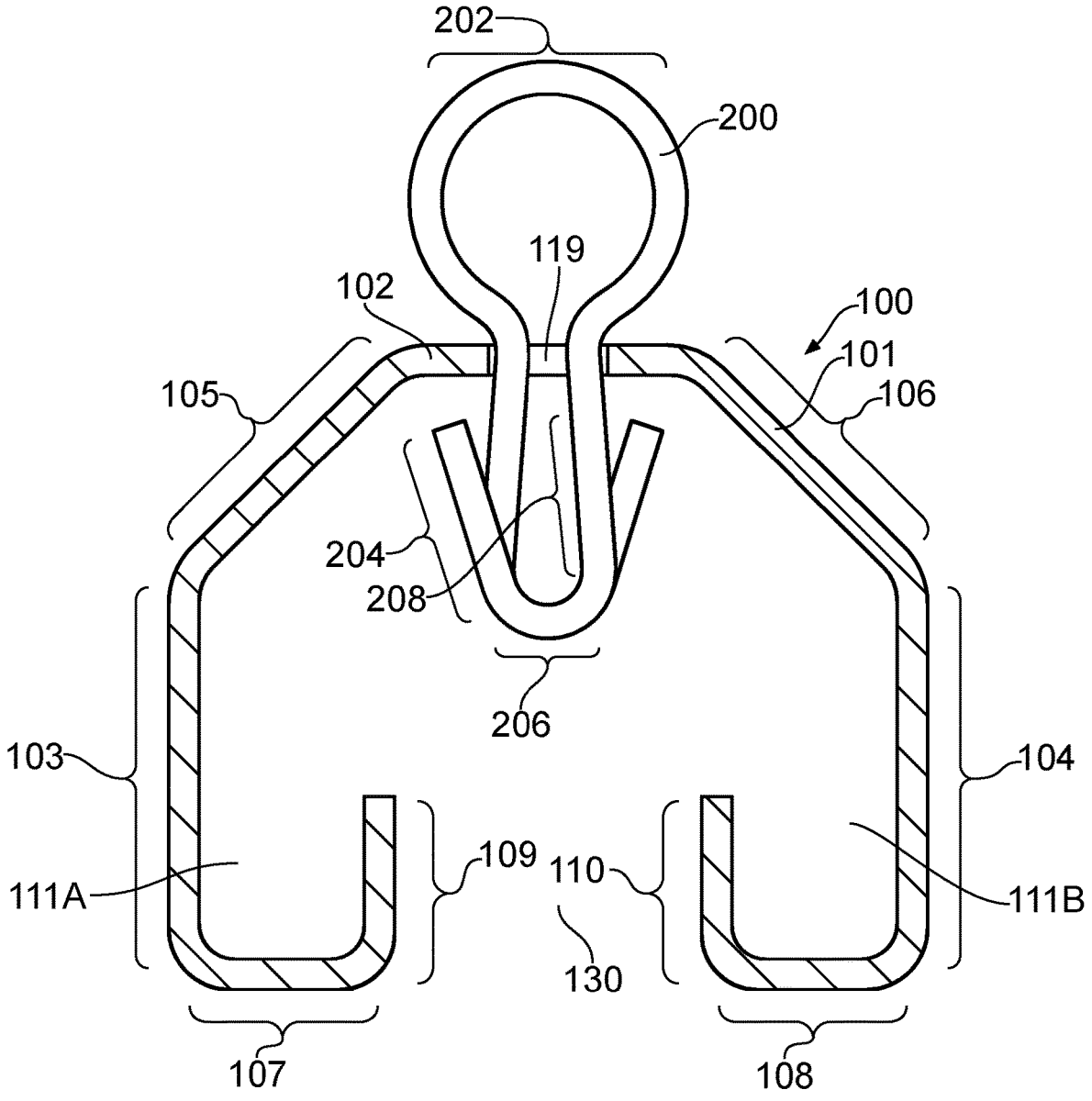
FIG. 9 shows a width-wise cross-section of a metal fence post with a penetrated line wire retaining clip.

FIG. 9 shows a width-wise cross-section of a metal fence post 100 with a penetrated line wire retaining clip 200.

It will be recognised that as the apex of each U is brought into contact with a single aperture 119 the distal portions 204 and proximate portions 208 of the wire forming the coupling portions are caused to deflect. As force is applied to the central line wire securing portion 202 the pairs of distal and proximate portions deflect towards each other reducing the width of each coupling portion 206 such that each coupling portion can penetrate and pass through the respective aperture 119.

As shown in FIG. 9 the line wire retaining clip 200 has been pushed against the post such that the above deflection occurs. Because of the elastic property of the material forming the clip, each of the retaining portions 206 returns to its original un-deflected position once through the aperture. As shown, the two distal portions 204 project beyond the edges of aperture 119. This prevents the clip from being retracted through the aperture.

In use, the central line wire securing portion 202 can retain fencing wires such as line wires, barbed wires or electrical wires inside its circular "loop".

Attaching a plurality of line wire retaining clips 200 can thereby restrain line wires against metal fence posts 100 to form a fencing system. It will be recognised that the line wire retaining clips 200 and apertures 119 advantageously allow line wires to be restrained with ease without bespoke or specialised tooling. The system can also be used very quickly owing to the clip arrangement and when a mixture of retaining clips 112 and line wire retaining clips 200 are used, the system allows for a mixture of line wires and mesh netting to be simultaneously restrained.

The invention claimed is:

1. A metal fencing system comprising:

a plurality of bent sheet metal fence posts, each defining a cavity receiving an I-shaped reinforcing member therein, and each comprising a hollow U-shaped cross-sectional profile having a base wall and a pair of perpendicularly-extending opposing side walls with inwardly-bent U-shaped end portions, the U-shaped end portions defining opposing channels therein and defining a slot therebetween extending along the length of the fence post, the opposing channels receiving opposing flanges of the I-shaped reinforcing member, and wherein the base wall comprises a plurality of discrete apertures uniformly spaced and longitudinally-aligned along the length of the fence post; and a plurality of retaining clips, each comprising a straight central fencing wire securing portion and a pair of V-shaped coupling portions disposed at opposing ends of the straight central portion, wherein apexes of the V-shaped portions extend in a same direction away from the straight central portion, the coupling portions received within adjacent apertures of one of the fence posts to secure a strand of fencing wire between the straight central portion and the base wall of the fence post, and wherein a vertical adjustment space is formed between the straight central portion and the base wall to allow the fencing wire to be vertically adjusted, wherein each of the coupling portions comprises a first portion connected to and extending away from the straight central portion and a second distal portion extending towards the straight central portion, wherein the first portion extends in a generally perpendicular direction from the straight central portion, and wherein the second distal portion deflects towards the first portion when inserted into an aperture of one of the fence posts and resiliently returns to an un-deflected position once through the aperture to engage an inner surface of the fence post, and wherein a pair of adjacent retaining clips is received within a series of three adjacent apertures of one of the fence posts, such that a lower coupling portion of an upper retaining clip of the pair of adjacent retaining clips is received within a same aperture as an upper coupling portion of a lower retaining clip of the pair of adjacent retaining clips, and wherein the apertures are sized and shaped such that the lower coupling portion of the upper retaining clip and the upper coupling portion of the lower retaining clip are inserted into and secured within the same aperture in laterally-offset side-by-side positions.

2. The metal fencing system according to claim 1, wherein each metal fence post is sufficiently rigid such that the metal fence post does not deflect when at least one of the two coupling portions penetrates an aperture of the metal fence post.

3. The metal fencing system according to claim 1, wherein the apertures are circular.

4. The metal fencing system according to claim 1, wherein the apertures are rectangular.

5. The metal fencing system according to claim 1, wherein a portion of each of the apertures are chamfered such that the chamfer cooperates with the two opposing coupling portions of one of the retaining clips.

6. The metal fencing system according to claim 1, wherein at least a subset of the apertures are arranged in a line along one of the metal fence posts.

7. The metal fencing system according to claim 1, wherein at least a subset of the apertures are arranged in two lines.

8. The metal fencing system according to claim 1, wherein the apertures are adapted to contact a portion of a coupling portion to restrict free rotation of the coupling portion relative to an aperture when the coupling portion is located in an aperture.

9. The metal fencing system according to claim 1, wherein the apertures are in the form of punched holes penetrating a wall of the metal fence posts.

10. The metal fencing system according to claim 1, wherein the apertures are in the form of drilled holes penetrating a wall of the metal fence posts.

11. The metal fencing system according to claim 1, wherein each of the coupling portions has an angle of less than 90 degrees between the first portion and the straight central fencing wire securing portion.

12. The metal fencing system according to claim 1, wherein rigidity of the coupling portions is set such as to allow a user to cause the coupling portions to penetrate through the apertures of the metal fence posts using hand force.

13. The metal fencing system according to claim 1, wherein, in use, the vertical adjustment space, provides an area in which the fencing wire is vertically adjusted, while the fencing wire remains compressed between the straight central fencing wire securing portion and the surface against which the fencing wire may be secured.

* * * * *